US007386976B2

(12) United States Patent
Weide

(10) Patent No.: US 7,386,976 B2
(45) Date of Patent: Jun. 17, 2008

(54) SPINNING DEVICE FOR PRODUCING A YARN BY MEANS OF A CIRCULATING AIR FLOW

(75) Inventor: Thomas Weide, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 11 days.

(21) Appl. No.: 11/490,656

(22) Filed: Jul. 21, 2006

(65) Prior Publication Data

US 2007/0022729 A1 Feb. 1, 2007

(30) Foreign Application Priority Data

Jul. 27, 2005 (DE) ..... 10 2005 035 049

(51) Int. Cl.
*D01H 4/02* (2006.01)

(52) U.S. Cl. ..... 57/350

(58) Field of Classification Search ..... 57/315, 57/350

See application file for complete search history.

(56) References Cited

U.S. PATENT DOCUMENTS

| | | | | |
|---|---|---|---|---|
| 5,146,740 | A * | 9/1992 | Mori | 57/328 |
| 5,159,806 | A | 11/1992 | Mori et al. | 57/328 |
| 5,193,335 | A * | 3/1993 | Mori | 57/296 |
| 5,295,349 | A * | 3/1994 | Okamoto | 57/333 |
| 5,699,661 | A * | 12/1997 | Maruki | 57/328 |
| 6,209,304 | B1 | 4/2001 | Feuerlohn et al. | 57/328 |

FOREIGN PATENT DOCUMENTS

| | | |
|---|---|---|
| DE | 40 36 119 A1 | 5/1991 |
| DE | 199 26 492 A1 | 4/2000 |

* cited by examiner

*Primary Examiner*—Shaun R. Hurley
(74) *Attorney, Agent, or Firm*—Kennedy Covington Lobdell & Hickman, LLP

(57) ABSTRACT

A spinning device for producing a yarn by a circulating air flow, comprising a hollow spinning cone arranged in a spinning housing and rotatably mounted about a central longitudinal axis and a nozzle block which can be loaded with compressed air to generate the circulating air flow. The spinning cone (19) is mounted via a bearing arrangement (30) in the rear housing part (15) such that the installation angle position of the spinning cone (19) can be adjusted selectively inside the air spinning device (5).

8 Claims, 2 Drawing Sheets

SPINNING DEVICE FOR PRODUCING A YARN BY MEANS OF A CIRCULATING AIR FLOW

CROSS-REFERENCES TO RELATED APPLICATIONS

This application claims the benefit of German patent application 10 2005 035 049.6 filed Jul. 27, 2005, herein incorporated by reference.

BACKGROUND OF THE INVENTION

The invention relates to a spinning device for producing a yarn by means of a circulating air flow and, more particularly, comprising a hollow spinning cone arranged in a spinning housing and rotatably mounted about a central longitudinal axis, and a nozzle block which can be loaded with compressed air to generate the circulating air flow.

Air spinning devices for producing textile yarns are known in various embodiments and described in the patent literature.

German Patent Publication DE 40 36 119 C2 describes an air spinning device, for example, in which a fiber yarn drawn in an upstream drafting arrangement is introduced through a nozzle block into an air spinning device and arrives via a fiber band guide, which also acts as a twist stop in the inlet opening of a spinning spindle which rotates during the spinning process and is acted upon via a drive belt. On entry of the fiber band into the rotating spinning spindle, the free fiber ends are looped by means of a circulating air flow around the conical spindle head of the spinning spindle and, while the yarn is being drawn into the spindle, wind spirally around the so-called core fibers. Thus, the core fibers, together with the so-called winding fibers, form a new yarn.

The drawback in this known air spinning device, however, is that the device is relatively maintenance-intensive due to its rotatably mounted, driven spinning spindle.

A comparable device for producing a yarn by means of a circulating air flow is known from German Patent Publication DE 199 26 492 A1. In this air spinning device, the fiber band to be spun is also introduced via a fiber band guide and a nozzle block into the air spinning device and arrives in the inlet opening of a stationarily arranged hollow spinning cone. In other words, the spinning cone of this known air spinning device is not rotatably mounted, but rigidly connected to the housing of the air spinning device. As already mentioned above in conjunction with German Patent Publication DE 40 36 119 C2, the fiber band is subjected to a circulating air flow in the region of the inlet opening of the spinning cone, which air flow places the free fiber ends of the fiber band around the head of the spinning cone. When the fiber yarn is subsequently drawn into the hollow spinning cone the free fiber ends also loop spirally, as so-called winding fibers, around the core fibers and thus form a yarn.

Air spinning devices according to German Patent Publication DE 199 26 492 A1 are distinguished above all by a relatively simple design construction and are relatively low in maintenance. However, it has been shown that in the case of air spinning devices of this type with a fixed spinning cone, even though it is made of a very wear-resistant material, preferably an industrial ceramics material, there is the risk of traces of wear occurring over time in certain areas of the head of the spinning cone and these have negative effects on the functioning capacity of the device.

SUMMARY OF THE INVENTION

Proceeding from spinning devices of the type mentioned at the outset, the invention is based on the object of improving air spinning devices with a spinning cone which is stationary during the spinning process by significantly extending the service life of the mechanisms, in particular the service life of the highly stressed spinning cone.

This object is addressed according to the invention by a spinning device for producing a yarn by a circulating air flow, basically comprising a hollow spinning cone arranged in a spinning housing and rotatably mounted about a central longitudinal axis, and a nozzle block which can be loaded with compressed air to generate the circulating air flow. According to the present invention, the spinning cone is mounted via a bearing arrangement in a rear housing part of the air spinning device at an installation angle position of the spinning cone which can be selectively adjusted inside the air spinning device.

Advantageous further configurations and features of preferred embodiments of the invention are discussed hereinbelow.

For example, the configuration of an air spinning device according to the invention with a spinning cone which can be adjusted with regard to its installation angle position, has the advantage that during the usage time of the spinning device, the position of the spinning cone with respect to its bearing arrangement can be easily changed repeatedly and point-wise over-stressing of the spinning cone material, which would lead to premature wear of the spinning cone, can thus be prevented. In other words, by repeatedly rotating the spinning cone about its longitudinal axis, preferably by one or more angular degree(s), for example randomly in the course of a spinning interruption, at each spinning interruption or else at periodic intervals, the impact points of the air flows introduced through the blast nozzles and impacting on the spinning cone in the region of the head, which are primarily responsible for the increased wear, can be gradually distributed over the entire periphery of the spinning cone.

In this manner, particularly high material stressing of individual points of the spinning cone can be successfully prevented and it can be ensured that in the course of time, the entire periphery of the spinning cone head is stressed virtually uniformly.

The spinning cone is advantageously rotatably mounted via a clearance fit, for example, in the rear bearing housing of the outer housing of the air spinning device and, is fixed, if necessary to be easily releasable, by a permanent magnet arrangement in the desired installation angle position on the outer housing. Such a simple and robust construction ensures, on the one hand, reliable fixing of the spinning cone during the spinning process and, on the other hand, makes it possible for the operating staff to adjust the installation angle position of the spinning cone without problems, preferably with reference to an event or time, but also randomly.

The adjustment of the installation angle position of the spinning cone, which is preferably only a few angular degrees, in each case, takes place in an advantageous embodiment, by hand, by the operating staff. Such a manually adjustable spinning cone is economical to manufacture, on the one hand, and easy for the operating staff to operate, on the other hand.

In a preferred embodiment, the spinning cone also has a marking, from which the respective installation angle position of the spinning cone can easily be recognized in the bearing arrangement. It can easily be ascertained, by means of a marking of this type, for example by means of a simple comparison of the installation angle position of the relevant spinning cone with the installation angle position of adjacent spinning cones, whether the relevant spinning cone has already been rotated into its new angle position with regard to rotation or whether it has so far been neglected to rotate this spinning cone into the new position. In other words, a marking of this type substantially facilitates uniform adjustment of the installation angle positions of the spinning cones.

The marking is preferably arranged on an adjusting ring, which is arranged so as to be rotationally engaged on the spinning cone at the rear end of the spinning cone and is configured such that the spinning cone can easily be adjusted manually with respect to its installation angle position.

In an alternative embodiment, the spinning cone has a mechanism, which can be actuated by an automatically working operating unit. This mechanism, for example teeth arranged on the outer periphery of the adjusting ring, can be acted upon by a corresponding handling mechanism of the operating unit. In other words, the automatically operating unit, preferably an operating traveller patrolling along the workstations of the textile machine can adjust, in a defined manner, the installation angle position of the spinning cone by means of a corresponding handling device and change it if necessary at any time.

Further details of the invention will be described hereinafter with the aid of an embodiment shown in the drawings, in which:

DESCRIPTION OF THE PREFERRED EMBODIMENT

Figure 1:
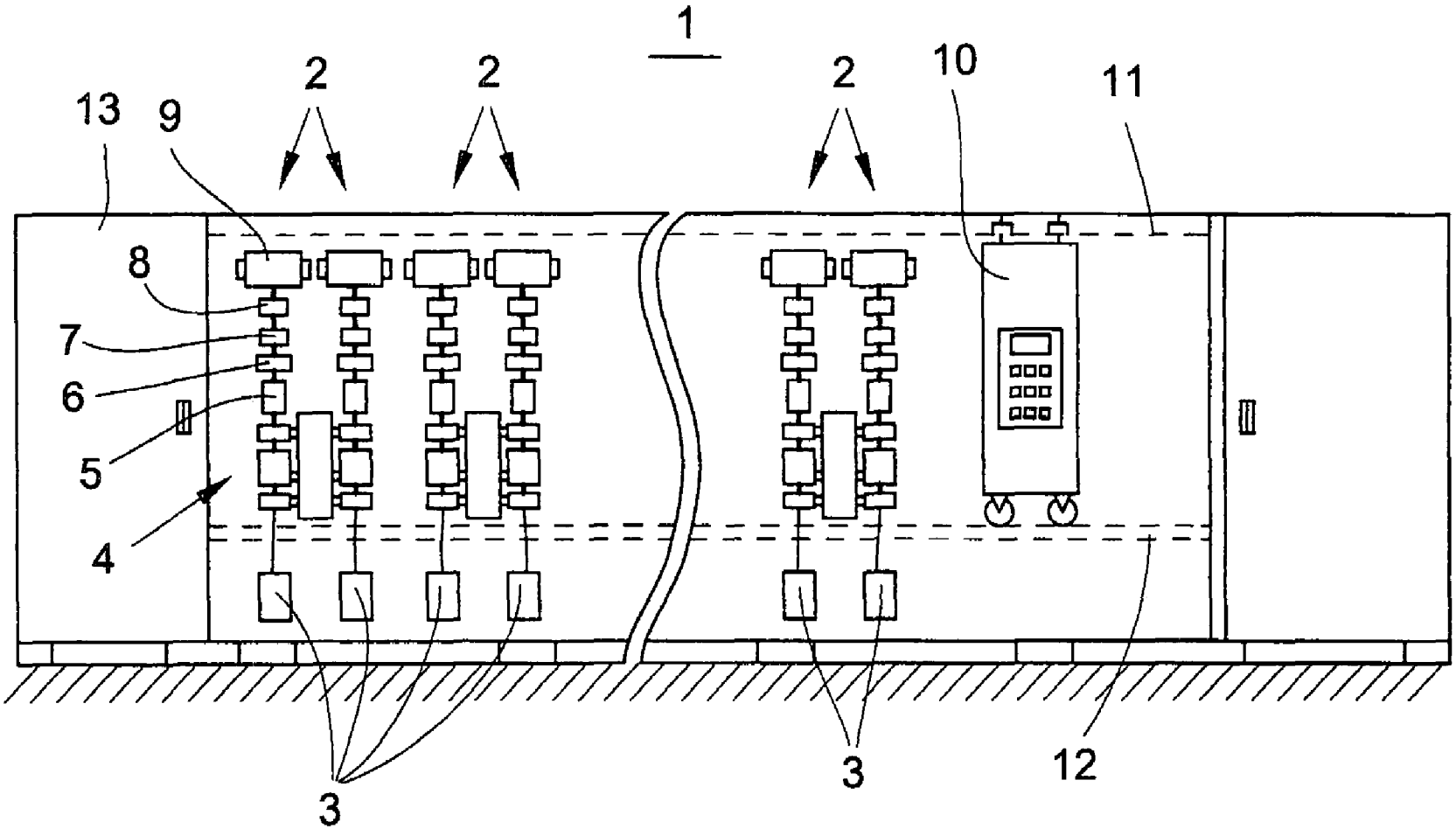
FIG. 1 shows a front view of a textile machine equipped with air spinning devices according to the invention and an operating traveller which can be moved along the workstations of the textile machine.

The air spinning machine 1 shown in a front view in FIG. 1 has a plurality of workstations 2 arranged next to one another in a row and a drive unit 13, at at least one end of the air spinning machine 1.

Each of the workstations or spinning stations 2 of the textile machine 1 has a fiber band source, for example a spinning can 3, a drafting arrangement 4, an air spinning device 5, a yarn draw-off mechanism 6, a yarn clearer 7 and a yarn traversing mechanism 8. The yarn traversing mechanism 8 ensures that the yarn finished in the air spinning device 5 is wound in crossing layers onto a take-up bobbin 9. The cross-wound bobbin 9, as usual, is held in a creel (not shown), and is rotated by a bobbin drive (also not shown). As also indicated in FIG. 1, the spinning stations 2 of the textile machine 1 are supplied by an automatically operating traveller 10, which, guided on rails 11, 12, can be moved along the spinning stations 2.

Figure 2:
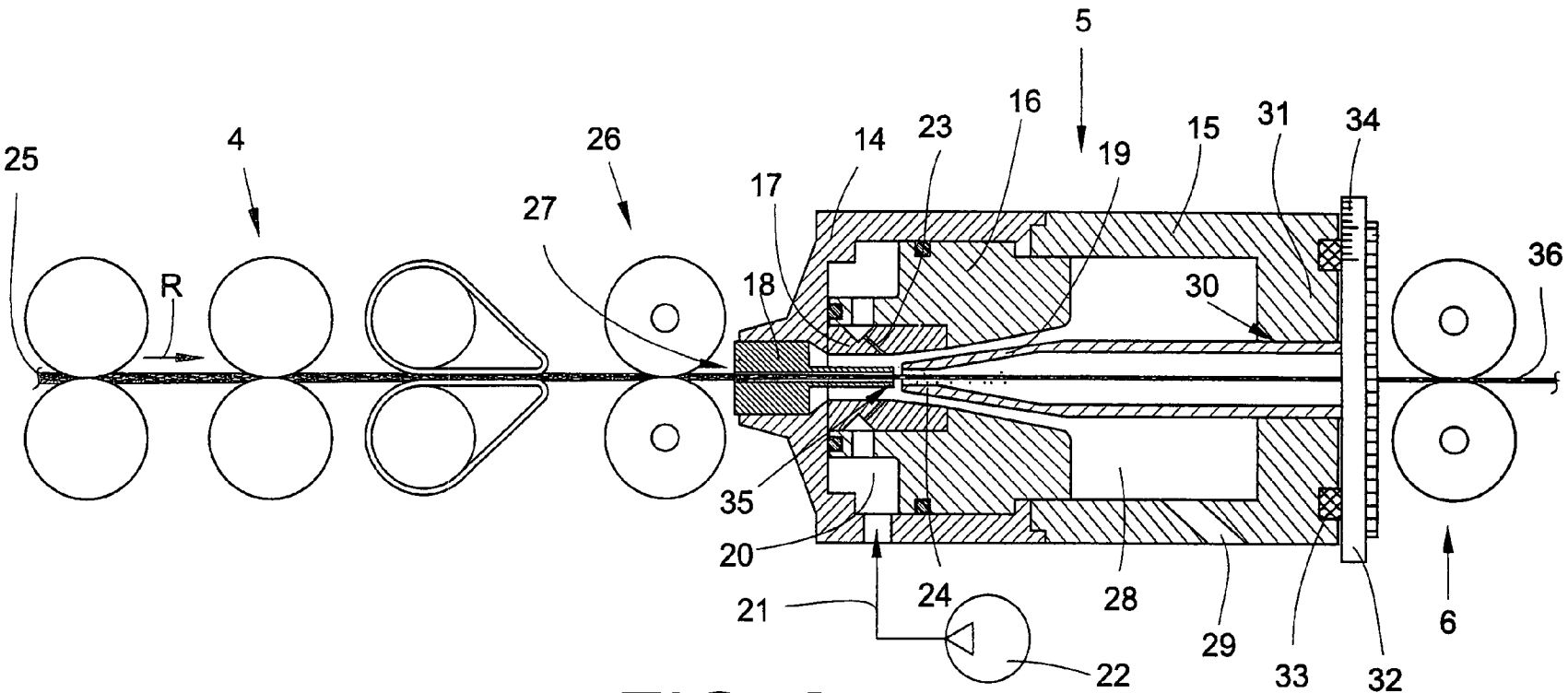
FIG. 2 shows schematically, in longitudinal section, an air spinning device according to the invention, comprising a spinning cone, which is stationary during the spinning process, which can be adjusted and fixed with respect to its installation angle position.

FIG. 2 shows the air spinning device 5, according to the invention, with the drafting arrangement 4 upstream in the fiber band running direction R and the downstream yarn draw-off mechanism 6. The air spinning device 5 is shown in section in this case. As can be seen, the air spinning device 5, substantially consists of a two-part outer housing 14, 15, an expansion housing 16, a nozzle block 17, a yarn band guide and twist stopping mechanism 18 and a hollow spinning cone 19. The expansion housing 16, in conjunction with the front housing part 14 of the outer housing, in this case forms a front annular space 20, which is connected via a pneumatic line 21 to an excess pressure source 22 and, in conjunction with the rear housing part 15 of the outer housing, forms an expansion space 28. While the expansion space 28 is connected via an air outlet opening 29 to the atmosphere, the annular space 20 is connected pneumatically continuously to blast air nozzles 23, which are arranged in the nozzle block 17. The blast air nozzles 23 are directed in this case tangentially onto the head 24 of the spinning cone 19 in the region of the inlet opening 35 of the spinning cone 19 such that a rotating air flow is adjusted.

The spinning cone 19 is also mounted via a bearing arrangement 30, which is arranged in the rear wall 31 of the rear housing part 15, so as to be rotatable about it central longitudinal axis relative to the outer housing 14, 15.

The spinning cone 19, which is preferably manufactured from a highly wear-resistant material, for example an industrial ceramics material, also has, viewed in the fiber band running direction R, an adjusting ring 32 with a marking 34, on the output side.

The adjusting ring 32, which is manufactured from a ferromagnetic material, preferably steel, is rigidly connected to the spinning cone 19 and corresponds with one or more permanent magnet(s) 33, which is/are let into the rear wall 31 of the housing part 15.

Operation of the air spinning device according to the invention occurs as follows:

As indicated in FIG. 2, the fiber band 25 stored in a spinning can 3, on its way to the cross-wound bobbin 9, initially runs through the grafting arrangement 4, where it is relatively strongly drawn. Via the withdrawal roller pair 26 of the drafting arrangement 4, the drawn fiber band 25 is transferred into the region of the inlet opening 27 of the air spinning device 5 and sucked into the air spinning device 5 under the influence of a reduced pressure flow present there. Inside the air spinning device 5, the fiber band 25 arrives via the fiber band guide and twist stopping mechanism 18 and the nozzle block 17 at the inlet opening 35 of the hollow spinning cone 19 and is drawn into the spinning cone 19 by the yarn 36 formed inside the spinning cone 19. The fiber band 25 is subjected, in this case, to the influence of a rotational flow in the region of the head 24 of the spinning cone 19. In other words, after leaving the fiber band guide and twist stopping mechanism 18, the rear, free ends of the edge fibers of the fiber band 25 are subjected to the action of an air flow leaving the blast air nozzles 23 of the nozzle block 17 such that they are lifted or released from the fiber band 25. The front ends of the fibers are not released, on the other hand, as they are already caught by the winding fibers and introduced into the hollow spinning cone 19.

The free fiber ends released from the fiber band 25 are also looped around the conical head 24 of the spinning cone 19 by the rotating air flow. Owing to the continuous movement of the fiber band 24 in the fiber band running direction R, the rear free end of the fibers 24 is continuously drawn into the hollow spinning cone 19, with the edge fibers being helically looped around the core fibers of the fiber band 25. The yarn 36 thus being produced is drawn via the yarn draw-off mechanism 6 from the air spinning device 5 and then wound to form a cross-wound bobbin 9.

The spinning cone 19 is rotatably mounted in the rear housing part 15 of the outer housing of the air spinning device 5 in a bearing arrangement 30, for example a simple clearance fit, and can be fixed magnetically in its respective installation angle position during the spinning process. In other words, in contrast to known air spinning devices, in which, owing to a fixed nozzle block and a fixed spinning cone, there is always the risk of the spinning cone being extremely worn at exposed positions in the long term, in the air spinning device 5 according to the invention, the spinning cone 19 can be adjusted with regard to its installation angle position. The spinning cone 19 can be selectively rotated, for example periodically at predeterminable time intervals, at a spinning interruption according to the random principle or at every spinning interruption, by a few angle degrees in each case with respect to its mounting and the stressing of the spinning cone 19 by the air flows leaving the blast air nozzles 23 or by the edge fibers looping around the head of the spinning cone can thereby be gradually distributed over the entire periphery of the spinning cone head and this has a very positive effect on the service life of the spinning cone 19.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A spinning device for producing a yarn by a circulating air flow, comprising a hollow spinning cone arranged in a spinning housing mounted about a central longitudinal axis, and a nozzle block which can be loaded with compressed air to generate the circulating air flow, wherein the spinning cone is mounted via a bearing arrangement (30) in a rear housing part (15) of the air spinning device (5) for selective adjusting of the angular position of the spinning cone (19) about the axis between angularly-spaced stationary spinning positions at each of which the spinning cone remains in a stationary non-rotating disposition during yarn spinning operation.

2. A spinning device according to claim 1, characterized in that the bearing (30) arrangement has a clearance fit for rotatable mounting of the spinning cone (19) in the rear housing part (15) of the air spinning device and in that, during the spinning process, the spinning cone (19) can be fixed by at least one permanent magnet (33) in its installation angle position.

3. A spinning device according to claim 1, characterized in that the installation position of the spinning cone (19) can be manually adjusted.

4. A spinning device according to claim 1, characterized in that a marking (34) is arranged on the spinning cone (19), which indicates the respective installation position of the spinning cone (19).

5. A spinning device according to claim 4, characterized in that the marking (32) is arranged on an adjusting ring (32), which is connected in a rotationally engaged manner to the spinning cone (19).

6. A spinning device according to claim 1, characterized in that the spinning cone (19) has a mechanism (37) which allows adjustment of the installation angle position of the spinning cone (19) by an automatic operating unit (10).

7. A spinning device according to claim 6, characterized in that the mechanism (37) comprises outer teeth on the spinning cone (19).

8. A spinning device according to claim 6, characterized in that the operating unit is configured as an operating traveller (10), which can be moved along the workstations (2) of the textile machine (1).

* * * * *